US005887469A

United States Patent [19]

Maeda et al.

[11] Patent Number: 5,887,469

[45] Date of Patent: Mar. 30, 1999

[54] TERMINAL CRIMPING DEVICE

[75] Inventors: Tatsuya Maeda; Chiaki Hatano, both of Shizuoka, Japan

[73] Assignee: Yazaki Corporation, Tokyo, Japan

[21] Appl. No.: 901,281

[22] Filed: Jul. 29, 1997

[30] Foreign Application Priority Data

Jul. 31, 1996 [JP] Japan ..... 8-201814

[51] Int. Cl.[6] ..... B21B 37/00

[52] U.S. Cl. ..... 72/20.1; 72/17.2; 72/21.3; 72/31.11; 72/441; 29/705; 29/753

[58] Field of Search ..... 72/15.1, 17.2, 72/19.8, 20.1, 20.2, 21.1, 21.2, 21.3, 31.11, 31.12, 374, 412, 414, 441, 443, 446, 453.14; 29/705, 753, 863

[56] References Cited

U.S. PATENT DOCUMENTS

| | | | |
|---|---|---|---|
| 5,092,026 | 3/1992 | Klemmer et al. | 29/593 |
| 5,337,589 | 8/1994 | Gloe et al. | 29/753 |
| 5,491,994 | 2/1996 | Baldyga | 72/20.1 |
| 5,587,633 | 12/1996 | Aoki et al. | 72/20.1 |
| 5,615,568 | 4/1997 | Matsumoto et al. | 72/20.1 |
| 5,669,257 | 9/1997 | Inoue et al. | 72/20.1 |
| 5,676,004 | 10/1997 | Matsumoto et al. | 72/20.1 |
| 5,697,146 | 12/1997 | Inoue et al. | 72/21.3 |

FOREIGN PATENT DOCUMENTS 8-236253 9/1996 Japan .

*Primary Examiner*—Joseph J. Hail, III
*Assistant Examiner*—Ed Tolan
*Attorney, Agent, or Firm*—Armstrong, Westerman Hattori, McLeland & Naughton

[57] ABSTRACT

A terminal crimping device includes an elevating crimper for crimping terminals onto exposed conductors of cables and an anvil positioned opposite to said elevating crimper so that the ascend/descend of the crimper is carried out by a servo motor. The terminal crimping device further includes a height sensor for outputting a crimp height at the time of crimping said terminals, a data storage unit for storing a pressing time range for determination on whether or not terminal crimping is normal and a crimper height value for determination of said pressing time; and determining unit for time measuring the time during which an output from said height sensor is not larger than the crimper height and determining that crimping is normal if the measured time is within said pressing time range. Thus, the determination on whether or not the terminal crimping is normal can be surely made.

2 Claims, 8 Drawing Sheets

FIG. 8B1 PRIOR ART

FIG. 8B2 PRIOR ART

FIG. 8C1 PRIOR ART

FIG. 8C2 PRIOR ART

TERMINAL CRIMPING DEVICE

BACKGROUND OF THE INVENTION

1. Field of the Invention

The present invention relates to a method of controlling a terminal crimping device which produces terminal-equipped cables constituting a wire harness or the like.

2. Description of the Prior Art

The terminal crimping device is, in general, composed of a crimper and an anvil set opposite to said crimper wherein the crimper performs the work of crimping terminals to the exposed conductors of the cables through elevating actions thereof. In this connection, the Japanese Patent Appln. No. 6-328827 discloses that the elevating actions are achieved by decelerating the rotation of the servo motor before being transmitted to a disk where the disk rotation is converted into a linear motion such that a ram loaded with said crimper is elevated and lowered. A detailed explanation thereof will be given with reference to FIGS. 8A to 8C and FIGS. 9A to 9B.

FIGS. 8A through 8C are figures explaining the action of the terminal crimping device; FIG. 9A is a graph showing the relationship between the crimper action time and the elevating speed; and FIG. 9B is a graph showing the relationship between the time and the motor current value wherein 1, 2, 3 in FIGS. 9A and 9B correspond to FIGS. 8A to 8C Referring to FIGS. 8A to 8C, the disk 7 is secured to the output shaft of the decelerator (not shown), which functions to decelerate the rotation of the servo motor.

Said disk 7 secured at an axis thereof to the output shaft of the decelerator carries an eccentric pin (crank shaft) 8 thereon. A crank rod 9 is pivotally attached at an upper end thereof to said eccentric pin 8 while said crank rod 9 is pivotally attached at a lower end thereof to a ram 11. Said ram 11 is loaded slidably in a vertical direction within a ram guide which is provided within the inner surfaces of a frame (not shown). In this way, the disk 7, the crank rod 9, the ram 11 and the ram guide constitute a piston/crank mechanism.

Said ram 11 is formed, at a lower end thereof, with an engagement recess 13, which is removably loaded with an engagement head 16 of a crimper holder 15 carrying a crimper 14. Immediately beneath said crimper 14, an anvil 17 is secured to a base 2 positioned opposite to said crimper 14.

FIG. 8A shows the start of the crimping step in which the crank pin 8 of the disk 7 takes an uppermost position to place the crimper 14 in the top dead center, when the descending speed of the crimper 14 stands at 0 while the load current stands at 0 as shown in FIG. 9A.

FIG. 8B shows a rotation of the disk 7 in the arrow-marked direction which causes the eccentric pin 8 to move downward until the crimper 14 reaches a position in its high speed descent to contact the barrel c of a terminal, thus starting a crimping action therefor. The descending speed of said crimper 14 is reduced before the contact thereof while reducing the load current.

FIG. 8C shows that the disk 7 rotates in the arrow-marked direction to move the eccentric pin 8 to the neighborhood of the bottom dead center such that the crimper 14 and the anvil 17 substantially performs the crimping work and, then, the crimper 14 provisionally comes to a stop at the crimping position. At this time, the crimper 14 is at rest (stop time t) showing a speed 0 while maintaining the state of pressurizing and pinching the barrel c of the terminal to continue the pressurizing action against the springback of the terminal barrel c, thus the load current reaching the peak value while showing a rising curve. Springback of said barrel c is prevented through this pressurizing and pinching action by this provisional halt.

After the terminal crimping, the servo motor 4 is caused to rotate the disk 7 in a direction reverse to the arrow-marked direction in the state shown in FIG. 10C such that the crimper 14 ascends to restore to the state (A).

In FIGS. 9A and 9B, the descending speed of the crimper 14 is sufficiently reduced from the speed thereof shown during the descent from the uppermost position to the terminal crimping start position. Therefore, such impact noise as caused in a conventional flywheel type terminal crimping device will not be generated, thus contributing to noise prevention and job site improvement.

As data for determining whether the terminal crimping performance is good or not, the current value Iu and Il as shown in FIG. 9B are stored.

More specifically, FIG. 9B shows that I represents a standard value at the time of a normal step of crimping a given terminal and a given cable size, Iu and Il represent a high limit and a low limit thereof, said high limit Iu and said low limit Il being established by a preliminary test. If I is between Iu and Ic, it means the normal crimping.

As described in the foregoing, the crimping performance of the conventional terminal crimping device is determined by determining whether the value of electric current at the time of terminal crimping operation is in the preset range thereof. The determination by such a value of electric current alone is susceptible to a significant error to such an extent that values otherwise to be rejected can happen to be among those determined acceptable.

SUMMARY OF THE INVENTION

An object of the present invention to provide a terminal crimping device to assure the determination whether the terminal crimping performance is good or not.

In order to attain the above object, in accordance with the present invention, there is provided a terminal crimping device composed of an elevating crimper for crimping terminals onto exposed conductors of cables and an anvil positioned opposite to said elevating crimper, comprising: a height sensor for outputting a crimper height at the time of crimping said terminals; a data storage unit for storing a pressing time range for determination on whether or not terminal crimping is normal and a crimp height value for determination of said pressing time; a determining unit for time measuring the time during which an output from said height sensor is not larger than said crimper height and determining that crimping is normal if the measured time is within said pressing time range.

Preferably, said crimper height is stored as a certain range in said data storage unit and said determining unit measures the pressing time as a time during which said height sensor is within the range of said crimper height.

The above and other object and features of the present invention will be more apparent from the following description taken in conjunction with the accompanying drawings.

BRIEF DESCRIPTION OF THE DRAWINGS

FIGS. 8A through 8C are views explaining the operation of the terminal crimping device (shown in FIG. 1)

DESCRIPTION OF THE PREFERRED EMBODIMENTS

Figure 1:
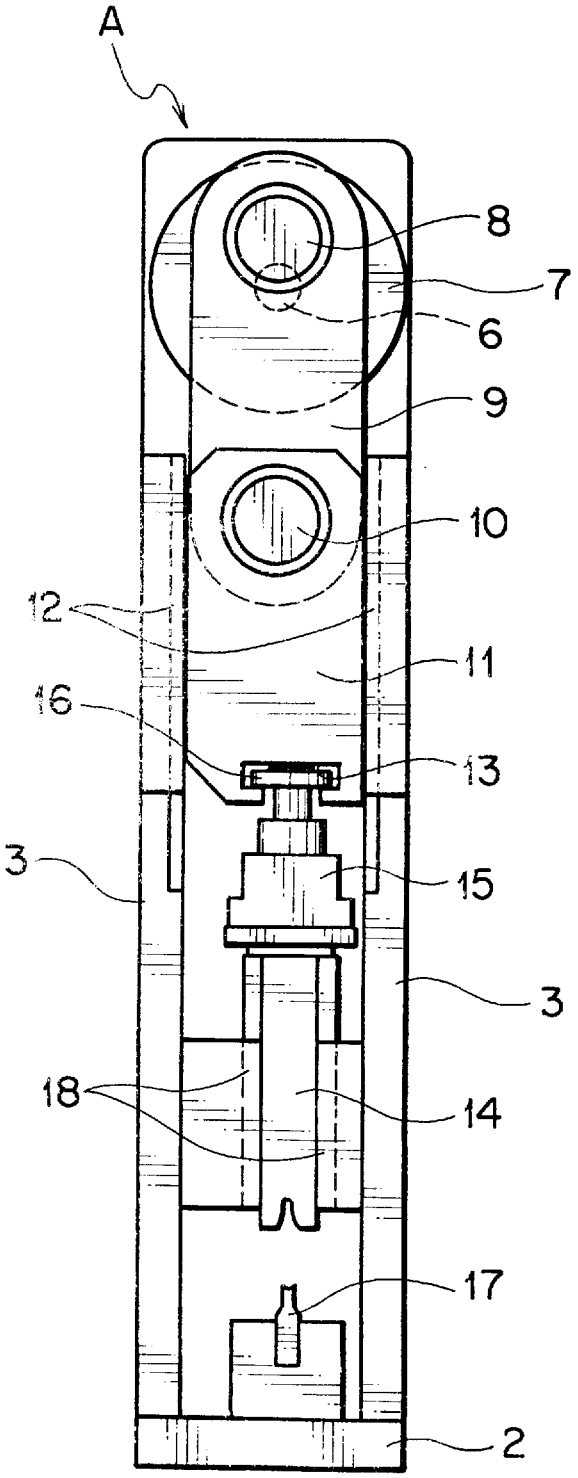
FIG. 1 is a front view of the terminal crimping device, showing one embodiment of the present invention.
Figure 2:
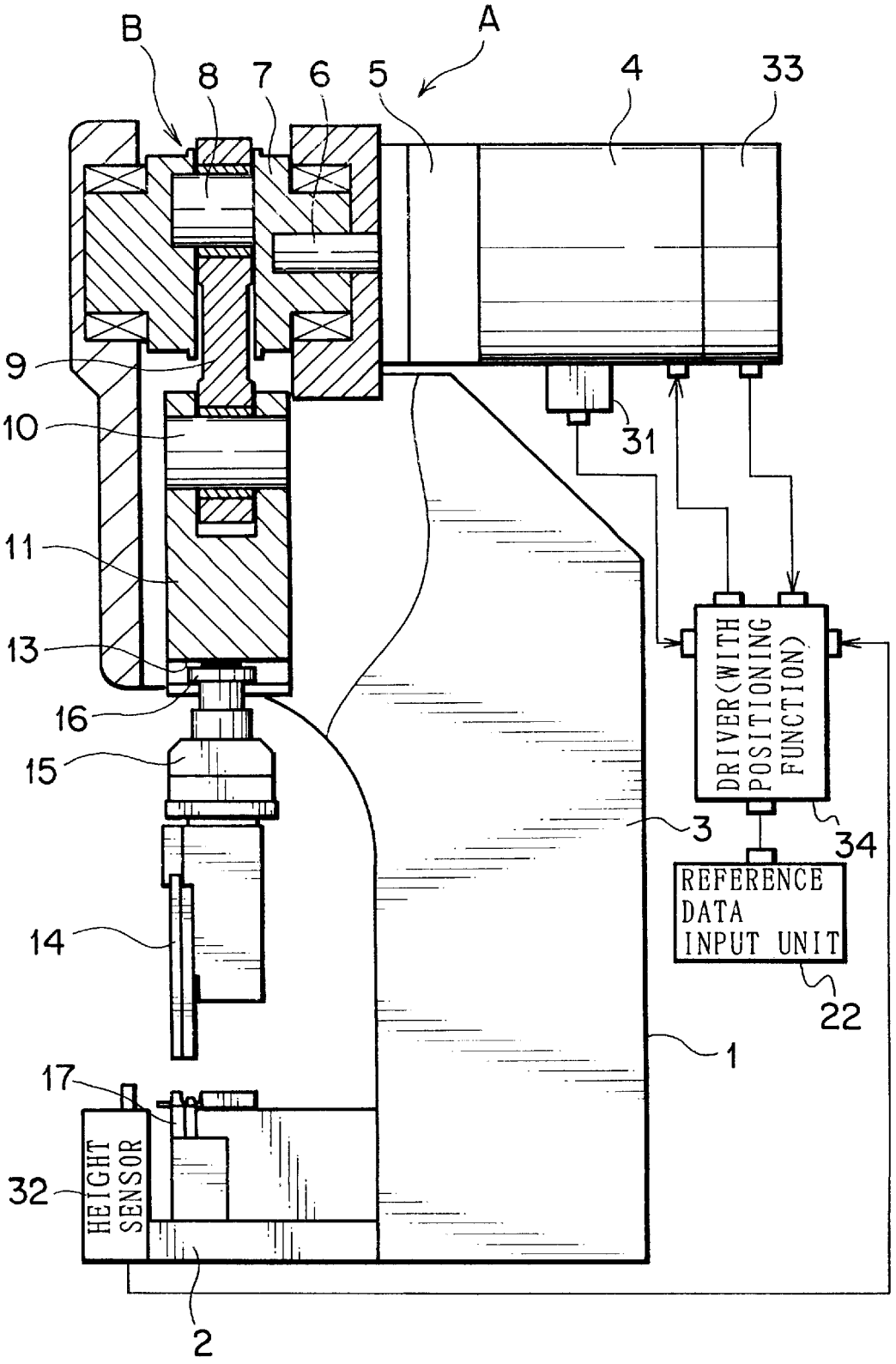
FIG. 2 is a side elevation of FIG. 1.

In FIGS. 1 and 2, reference numeral 1 denotes a casing of a terminal crimping device A which is generally composed of a base 2 and opposite side plates 3 thereof. Above said opposite side plates 3, a servo motor 4 having a reduction gear 5 is mounted thereto to extend rearwardly thereof. Said reduction gear 5 has an output shaft 6 which is secured to a disk 7 having an eccentric pin (crank shaft) 8. There is provided a crank rod 9 having an upper end pivotally attached to said eccentric pin 8. Said crank rod 9 further has a lower end again pivotally attached to a ram 11 via a pin shaft 10. Said ram 11 is loaded within ram guides 12 attached to the inner walls of said opposite side plates 3 such that said ram 11 is adapted to slide upwardly and downwardly therebetween. Thus, the disk 7, the crank rod 9 and the ram guides 12 constitute a piston/crank mechanism B.

The ram 11 is formed with an engagement recess 13 at an underside thereof such that an engagement head 16 formed in the crimper holder 15 attached to the crimper 14 is removably engaged in said engagement recess 13. Immediately beneath said crimper 14, there is set an anvil 17 mounted on the base 2 in an opposite relation to said crimper 14. The numeral 18 denotes guide plates for guiding the crimper holder 15 which are secured to the inner faces of the side plates 3 by way of brackets not shown.

The servo motor 4 is adapted to rotate forwardly and backwardly such that the piston/crank mechanism B causes the ram 11 pivotally attached to the crank rod 9 and, thus, the crimper 14 to descend and ascend, said motor 4 being connected to the driver 34 which controls the operation thereof. A reference data input unit 22 to the driver 34 is connected to said driver 34 for inputting thereto reference data including terminal standards (or sizes), cable sizes corresponding thereto, crimper heights (or lowest crimper positions) and loads (or electric currents) applied to the servo motor 4 or the like.

The servo motor 4 has an output shaft (not shown) attached to a rotary encoder 33 which detects positions of the crimper 14 on the basis of the number of its rotation to be fed back to the driver 34 which reads out said load current.

Numeral 32 denotes a height sensor which detects the height of the crimper 14 at the time of terminal crimping operation to input the same to the driver 34 for determining whether the performance of the terminal attaching operation is good or not. The numeral 31 denotes a temperature sensor for measuring the temperature of the coil of the servo motor 4.

Figure 3:
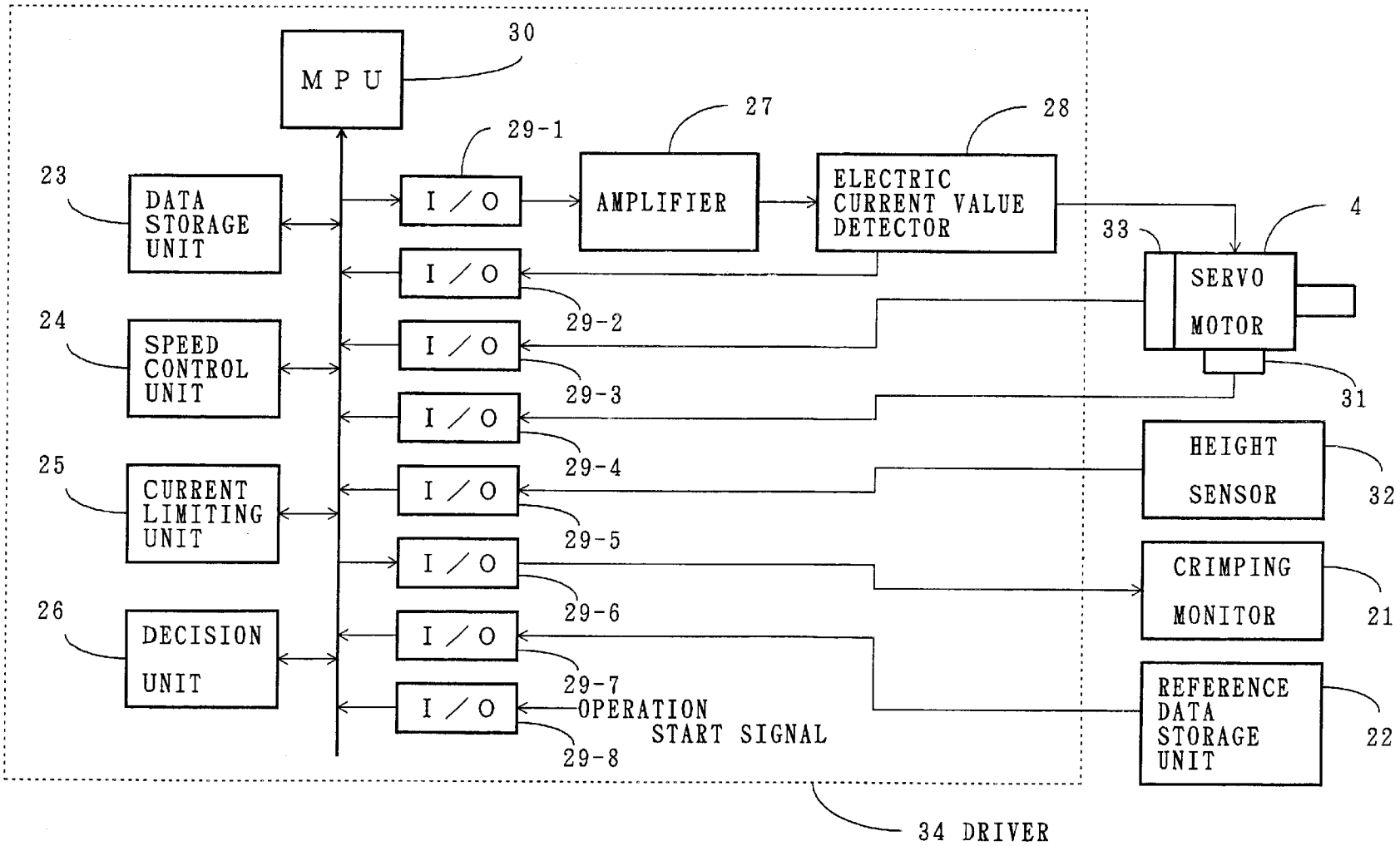
FIG. 3 is a function block diagram showing the control sequence of the terminal crimping device of FIG. 1.

FIG. 3 is a function block diagram of the driver 34 which drives the servo motor 4. As shown therein, the driver 34 is incorporated as a control circuit like a central processing unit; that is, said driver 34 is composed of data storage unit 23, speed control unit 24, current limiter 25, a decision unit 26, amplifier 27, a electric current value detector 28, an interface (I/O) 29 (29-1 through 29-8) and a microprocessor (MPU) 30 which performs the processing work.

Figure 8A:
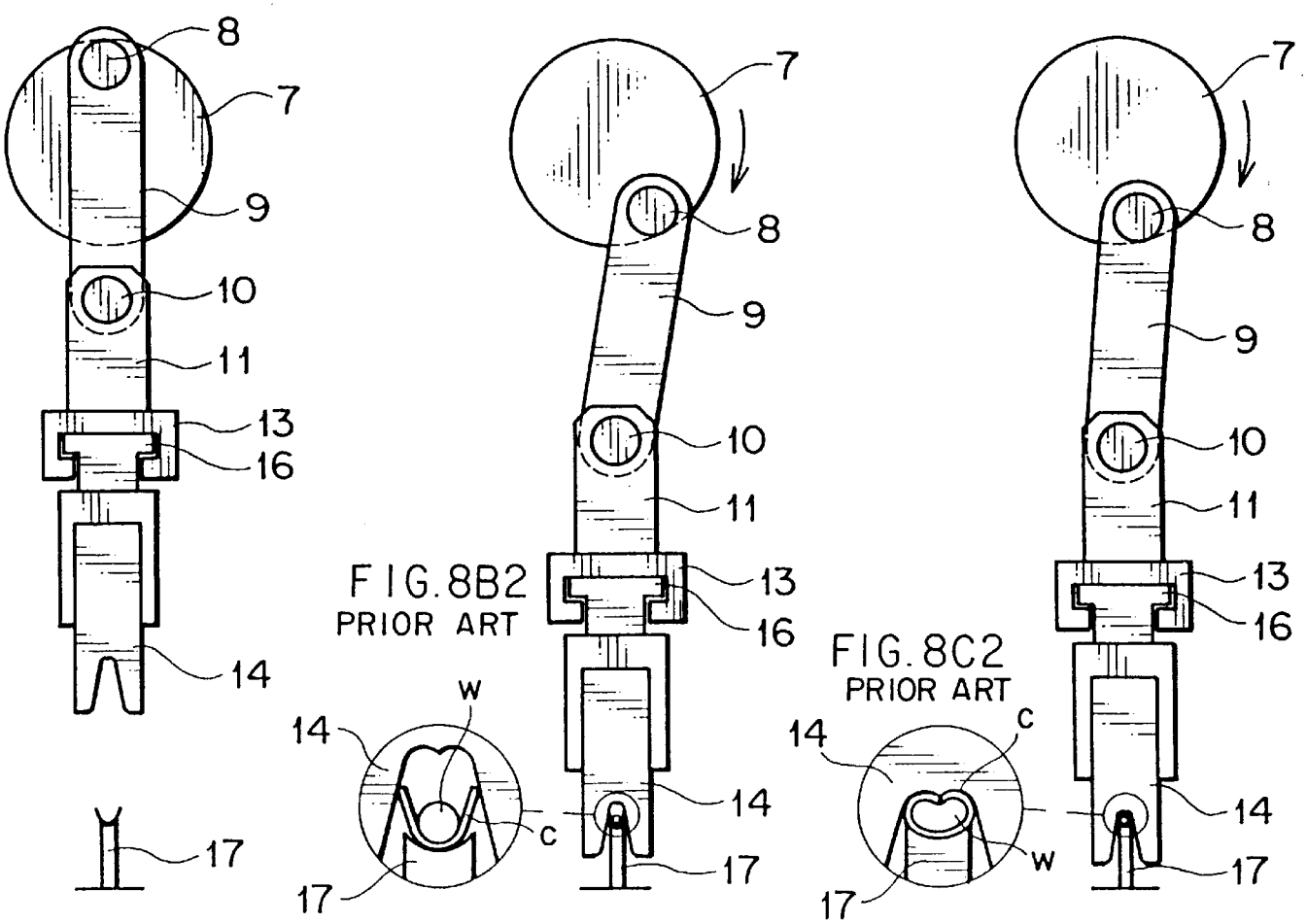
FIG. 8A PRIOR ART

The operating principle of said terminal crimping device will not be explained since it is substantially the same as explained referring to FIGS. 8 and 9 which show the prior art.

Now back to FIG. 3, data for driving the terminal crimping device A and data for determining whether the performance of the terminal crimping operation is good or not will be stored in advance into the data storage unit 23 by way of I/O 29-7 from the reference data input unit 22 prior to starting the operation of the terminal crimping device A.

Figure 9A:
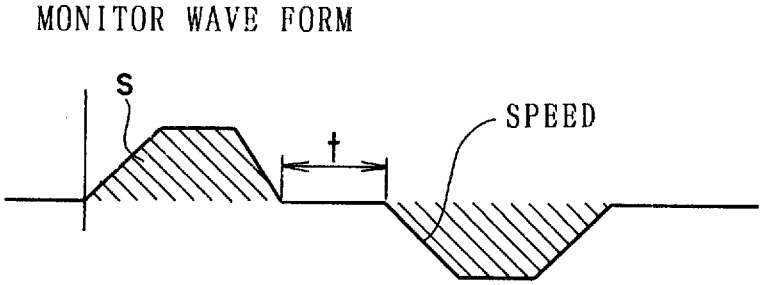
FIG. 9A PRIOR ART
FIG. 9A is a graph showing the relationship the time and the ascending/descending speed of the crimper at the time of crimping operation.
Figure 9B:
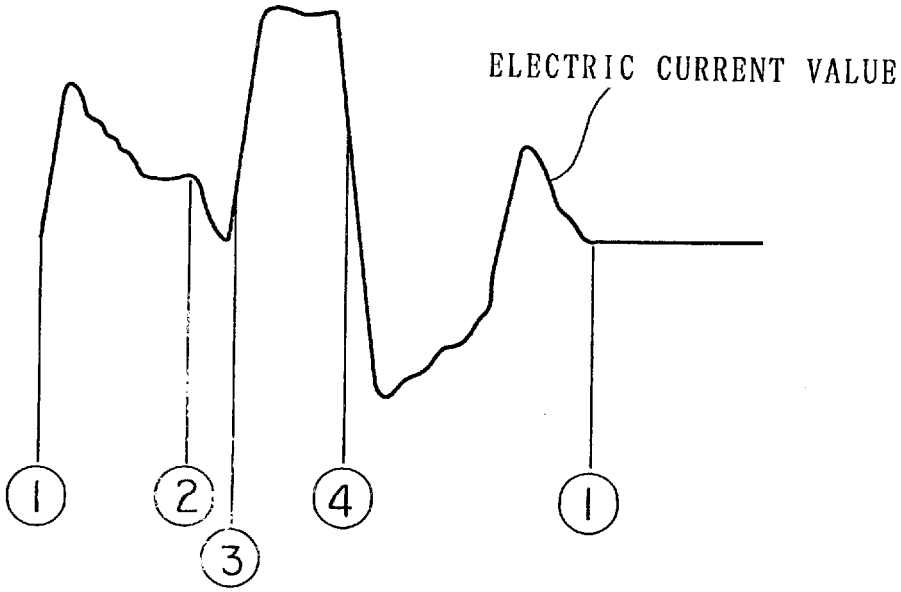
FIG. 9B PRIOR ART
FIG. 9B is a similar graph showing the relationship between the time and the motor current.

More specifically, the data to be stored for driving the terminal crimping device A as shown in FIG. 9B include (i) the acceleration after the start of a forward rotation of the motor and the position of the crimper 14 descending by the rotation of the motor at the time of the motor reaching a uniform speed, (ii) the position of the crimper 14 decelerated from the uniform speed and the deceleration at that time, (iii) the position of the crimper 14 at the time of starting the crimping, the given time period t and the drive current for driving the motor for said given time period, and iv) the acceleration at the time of reversing the motor after completion of the crimping to elevate the crimper 14, the position of the crimper 14 when the motor speed is brought to a uniform speed, the position of the crimper 14 when the motor is decelerated, and the position of the crimper 14 at a stop.

The positions of the crimper 14 are stored as values related to the output values of the rotary encoder 33 attached to the servo motor 4.

These data are obtained by conducting preliminary experiments for respective terminals to be crimped and the thus obtained data are stored. In this connection, the data corresponding to a plurality of terminals may be stored such that a relevant data are to be read out at the time of the operation.

The positions of the crimper 14 are to be stored in the form of values corresponding to the rotational angles of the disk 7 such that there is no need for varying the level of the anvil as required in the prior art even in the event of terminal replacement; that is, the procedure can be followed immediately to facilitate the adjustment of the crimper position at the start of crimping.

The data for determining whether the performance of the terminal crimping operation is good or not will be explained with reference to FIG. 7.

Figure 7:
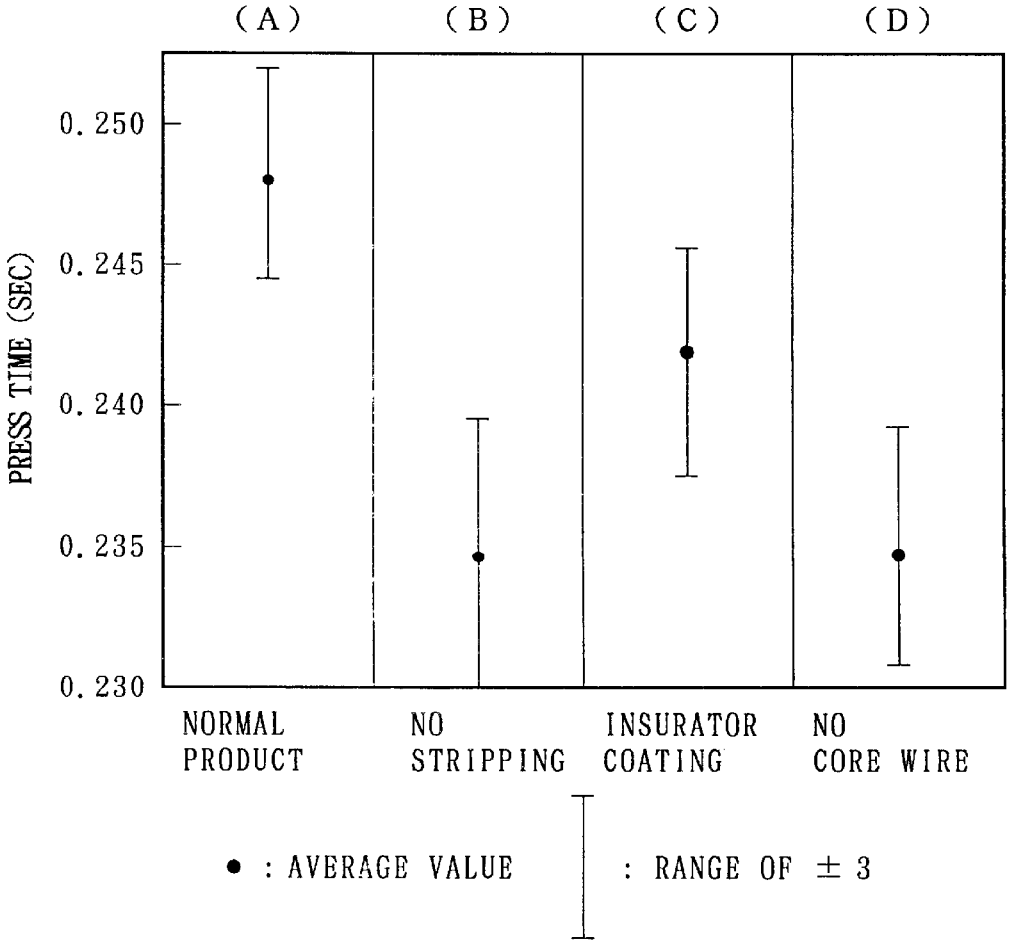
FIG. 7 is a view for explaining the determination value.

FIG. 7 is a graph showing the measurement results of the pressing time on (A) a normal product of terminal, (B) a terminal with no stripping, and (C) terminal with insulator coating within the time indicated by t in FIG. 9A while the crimping height (C/H) at the time of terminal crimping is lower than a prescribe value of 0.05 mm. As seen from this result, when the terminal has been normally crimped, the pressing time is long, whereas when the terminal has been not crimped normally like the product with not stripping and the product with an insulator catching, the pressing time is short. Thus, it is possible to discriminate whether or not the terminal has been normally crimped from the difference of pressing times.

As data for discriminating whether or not the terminal crimping is good or not, a prescribed value of the crimper height for deciding the pressing time on whether or not the terminal crimping is normal.

Additionally, FIG. 7(D) shows the measurement result of the time during which the crimping height is within a range of a C/H prescribed range of +0. 05 mm~0.1 mm which is used for decision of the product with not core wire. Therefore, for decision of no core wire, a prescribed range of the crimper height is stored.

Figure 4:
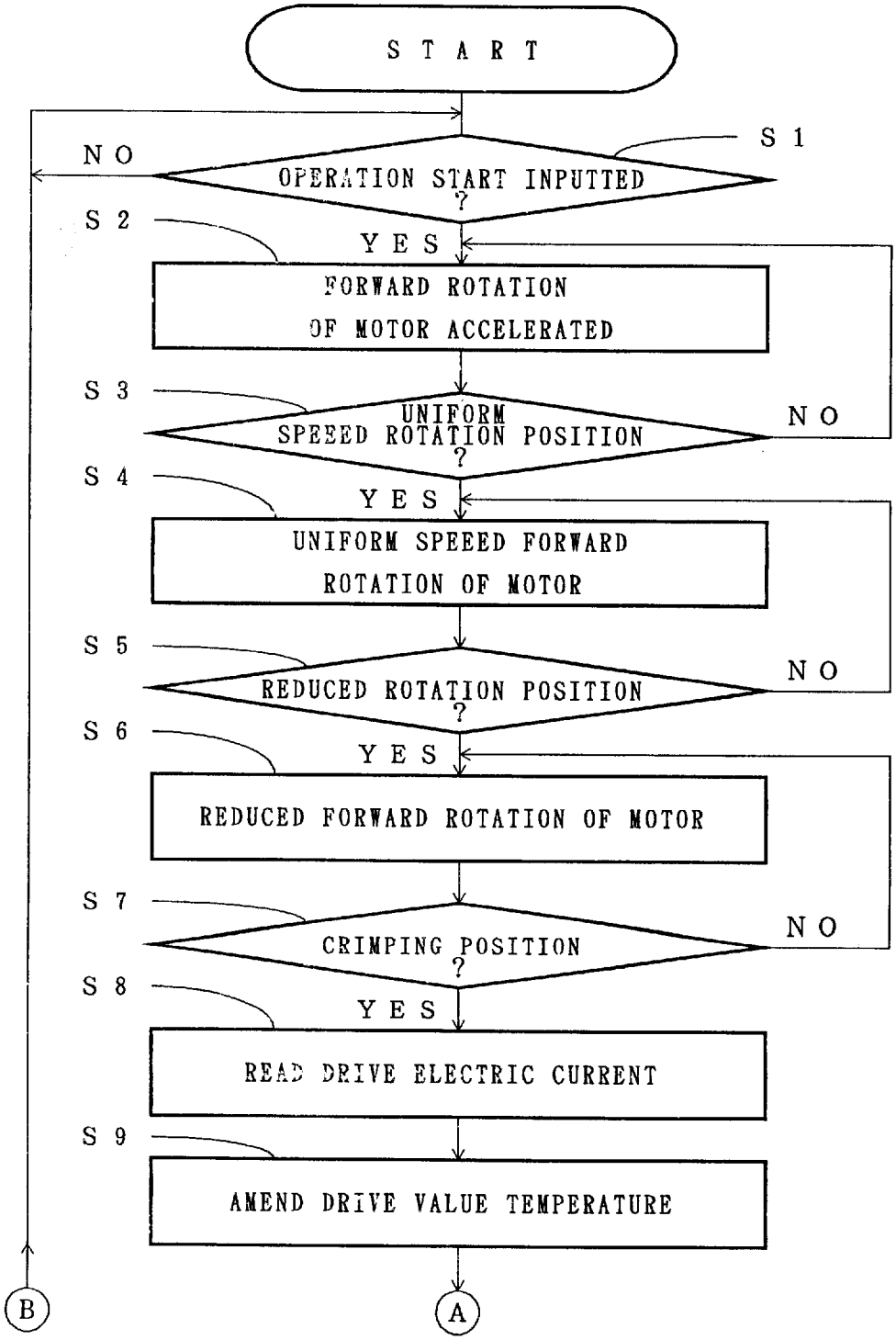
FIG. 4 is a flow chart showing the operation of FIG. 3.
Figure 5:
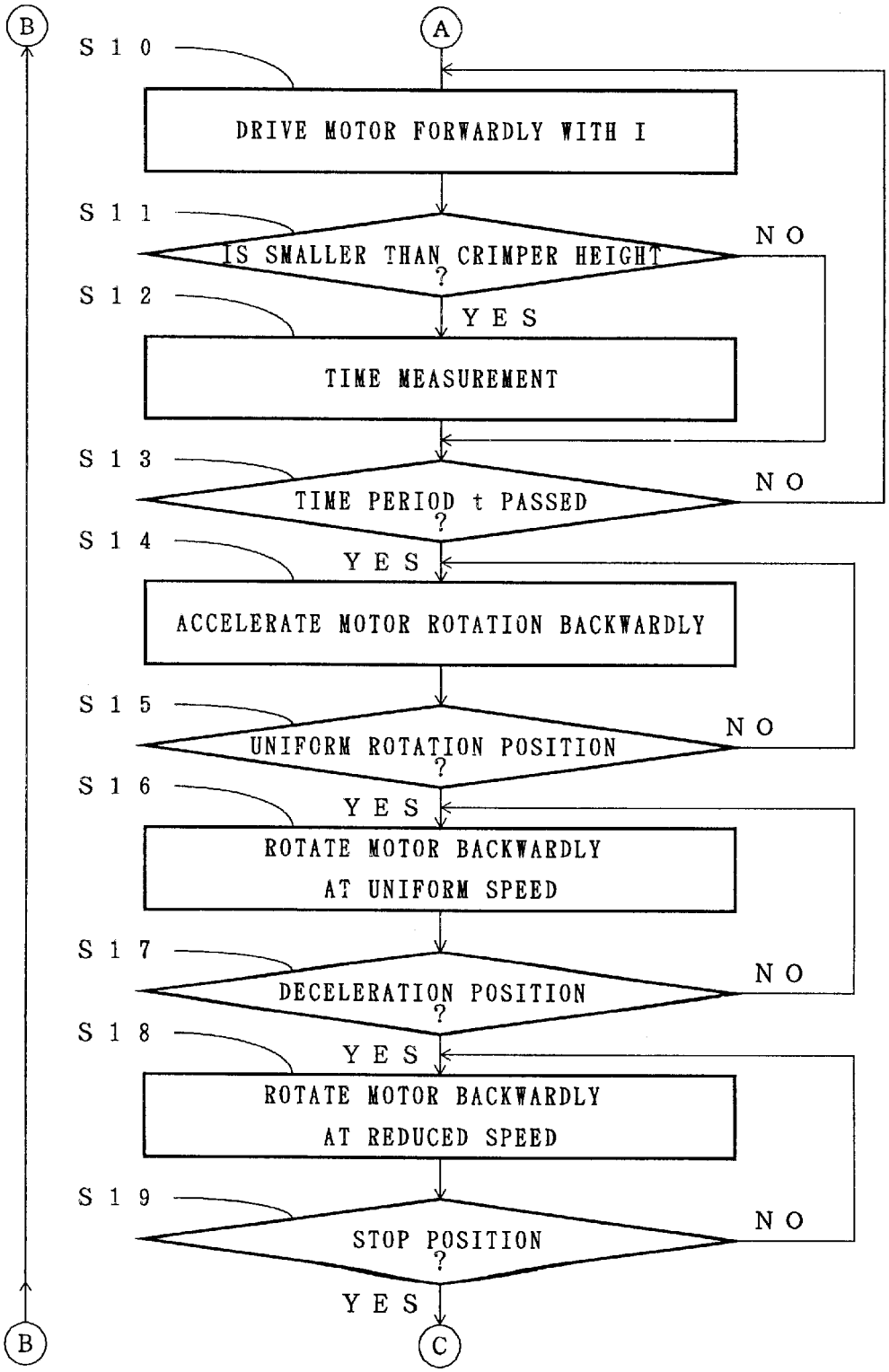
FIG. 5 is a flow chart showing the operation of FIG. 3.
Figure 6:
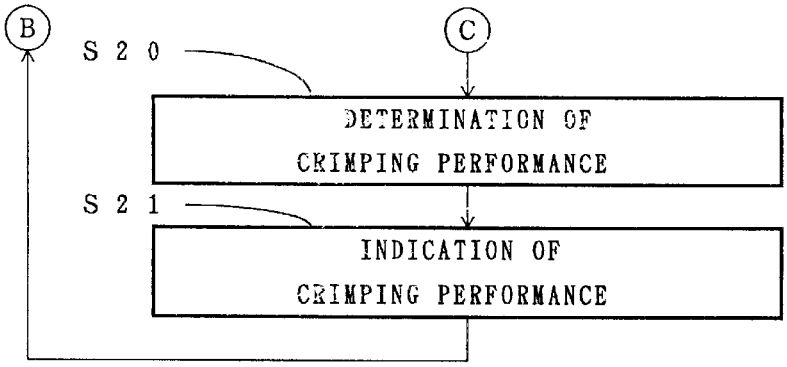
FIG. 6 is a flow chart showing the operation of the FIG. 3.

Next, the operation of the driver 34 will be explained with reference to FIGS. 4 to 6 which show a flow chart of the driver operation.

At step S1, the speed control unit 24 determines whether or not the signal for starting the crimping operation has been inputted and if the determination is NO, the program is suspended until YES.

At step S2, the speed control unit 24 reads out from the data storage unit 23 the acceleration for causing the servo motor 4 to rotate forwardly and said acceleration is outputted to the amplifier 27 by way of I/O 29-1 where the power amplification is effected to supply the electric current to the servo motor 4 such that the required speed is obtained.

In this connection, the acceleration for the motor rotation is obtained by reading out the output value of the rotary encoder 33 by way of I/O 29-3, differentiating the read out value to obtain the speed, and further differentiating the speed to obtain the acceleration.

At the step S3, the speed control section 24 determines whether or not the output value of the rotary encoder 33 inputted by way of I/O 29-3 has become a uniform rotation position and if the determination is NO, the acceleration applied at step S2 is continuously effected and if YES, the program proceeds to step S4 where the uniform speed rotation is effected.

Further, if the position for decelerated rotation is detected at the step S5, the program proceeds to step S6 where the speed control unit 24 reduces the motor rotation. At step S7, when the terminal reaches the crimping position, the current control unit 25 is thus notified.

At step S8, the current control unit 25 reads out the electric current value I which is stored at the data storage unit 23 to be supplied to the servo motor 4 at the time of terminal crimping operation. Then, the program proceeds to step S9 where an amendment is made thereto on the basis of the temperature value from the temperature sensor 31 inputted by way of I/O 29-4 such that the torque of the servo motor 4 reaches the prescribed value to output the value at step S10 by way of I/O 29-1.

At step S11, the decision unit 26 reads the prescribed value of the crimper height stored in the data storage unit 23 and determines whether the output from the height sensor 32 inputted from the I/O 29-5 is not larger than the prescribed value. If the determination is NO, the program proceeds to step S13.

At step S13, the electric current control unit 25 determines whether or not the electric current I is supplied to the servo motor 4 for a time period t and if the determination is NO, the program proceeds to the step S10 for execution of the steps S10 and S11.

At step S14, the speed control unit 24 causes the servo motor 4 to rotate by accelerating the same to obtain a designated acceleration in the backward direction until a value for the uniform speed rotation is determined at step S15 as having been obtained. Then, the program proceeds to step S10 to achieve a uniform speed rotation. At the step 17, if the position for reduction speed rotation is determined as having been reached, the program proceeds to step S18 for decelerated rotation, and at step S19 the rotation is stopped when the stop position is reached.

At step S20, the decision unit 26 determines that crimping is good if the pressing time measured at step S18 is within the range of that stored in the data storage unit 23, and that crimping is not good if the pressing time measured is outside the range. Then, at the step 20, an alarm is issued if necessary in the event of "not good" while the result is displayed 21 on the crimping monitor 21.

In the above embodiment, at step S11, although the crimper height has been determined if it is not larger than the prescribed value, the crimper height may be determined if or not it is within a prescribed range.

What is claimed is:

1. A terminal crimping device composed of an elevating crimper for crimping terminals onto exposed conductors of cables and an anvil positioned opposite to said elevating crimper, comprising:

a height sensor for outputting a crimper height at the time of crimping the terminals:

a data storage unit for storing a pressing time range for determination on whether or not terminal crimping is normal and a crimp height value for determination of the pressing time range; and a determining unit for measuring the time during which an output from said height sensor is not larger than the crimper height and determining that crimping is normal if the measured time is within the pressing time range, whereby it is possible to discriminate whether or not the terminal has been normally crimped from the measured time.

2. The terminal crimping device according to claim 1, wherein the crimper height is stored as a certain range in said data storage unit and said determining unit measures the pressing time as a time during which said height sensor is within the rage of the crimper height.

* * * * *